US005746134A

United States Patent [19]

Scheffel

[11] Patent Number: 5,746,134

[45] **Date of Patent: *May 5, 1998**

[54] RAILWAY VEHICLE SUSPENSIONS

[76] Inventor: Herbert Scheffel, 83A Van Wouw Street, Groenkloof, Pretoria, Transvaal, South Africa

[ * ] Notice: The term of this patent shall not extend beyond the expiration date of Pat. No. 5,588,367.

[21] Appl. No.: 703,967

[22] Filed: Aug. 28, 1996

Related U.S. Application Data

[63] Continuation-in-part of Ser. No. 207,730, Mar. 9, 1994, Pat. No. 5,588,367.

[30] Foreign Application Priority Data

Mar. 9, 1993 [ZA] South Africa ..... 93/1668

[51] Int. Cl.[6] ..... B61D 5/31; B61D 5/38

[52] U.S. Cl. ..... 105/168; 105/218.1

[58] Field of Search ..... 105/167, 168, 105/218.1, 218.2, 224.1, 171

[56] References Cited

U.S. PATENT DOCUMENTS

| | | | |
|---|---|---|---|
| 3,528,374 | 9/1970 | Wickens | 105/168 |
| 3,862,606 | 1/1975 | Scales | 105/167 |
| 4,067,261 | 1/1978 | Scheffel | 105/176 |
| 4,067,262 | 1/1978 | Scheffel | 105/168 |
| 4,300,454 | 11/1981 | Scheffel | 105/168 |
| 4,353,309 | 10/1982 | Pollard et al. | 105/136 |
| 4,679,507 | 7/1987 | Rassaian | 105/168 |
| 4,735,149 | 4/1988 | Scheffel et al. | 105/218.1 |
| 4,765,250 | 8/1988 | Goding | 105/166 |
| 5,263,420 | 11/1993 | Schwendt et al. | 105/168 |
| 5,555,816 | 9/1996 | Jones | 105/168 |
| 5,588,367 | 12/1996 | Scheffel | 105/168 |

FOREIGN PATENT DOCUMENTS

| | | | |
|---|---|---|---|
| 0 258 502 | 3/1988 | European Pat. Off. . | |
| 0 360 782 | 3/1990 | European Pat. Off. . | |
| 837 711 | 5/1952 | Germany | 105/168 |
| 30 42 597 | 6/1982 | Germany . | |
| 38 26 010 | 2/1989 | Germany . | |
| 41 42 255 | 7/1993 | Germany . | |
| 4/90963 | 3/1992 | Japan | 105/168 |
| 79/2395 | 5/1979 | South Africa . | |
| 82/6357 | 8/1982 | South Africa . | |
| 86/0633 | 1/1986 | South Africa . | |
| 1 508 194 | 4/1978 | United Kingdom . | |

*Primary Examiner*—S. Joseph Morano
*Attorney, Agent, or Firm*—Burns, Doane, Swecker & Mathis, L.L.P.

[57] ABSTRACT

A railway vehicle has a frame which is suspended on wheelsets each having a live axle. The ends of the axles are mounted in axleboxes. Couplings are provided which are attached to the vehicle frame and which couple an axlebox of one wheelset to an axlebox of another wheelset. The couplings are such as to constrain relative movements between the wheelsets in a lateral plane. In addition, each coupling includes a crank lever which operates to uncouple lateral movements of the frame from the movements of the wheelsets, thereby providing a shear stiffness to the vehicle and reducing vehicle hunting at speed. The crank levers are connected to the wheelboxes by links which are inclined with respect to a longitudinal axis of the frame, such that the links lie on axes which intersect at the longitudinal axis.

15 Claims, 8 Drawing Sheets

Fig. 6A
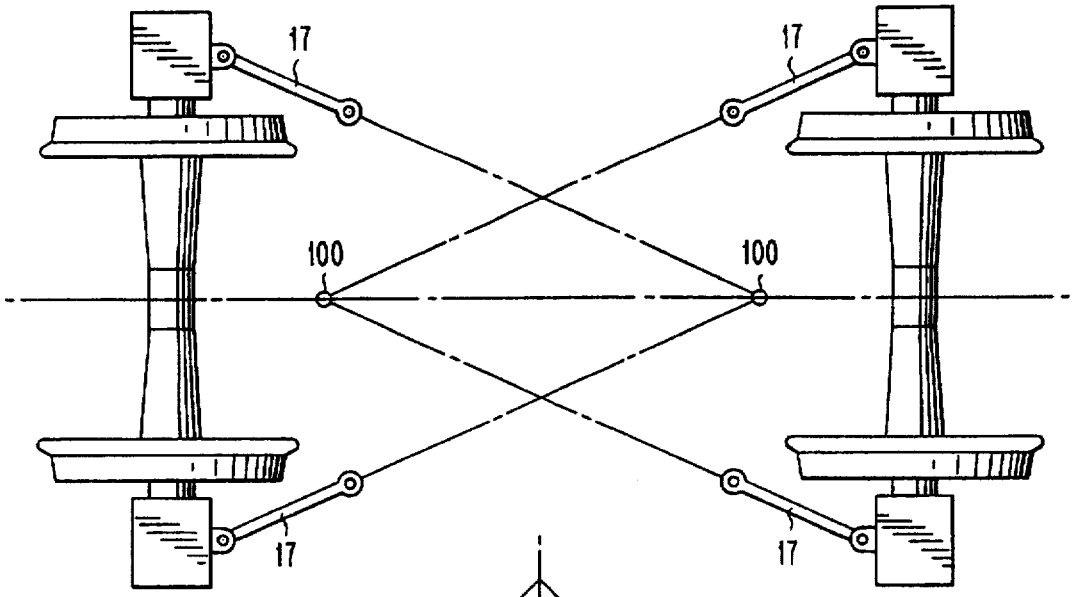
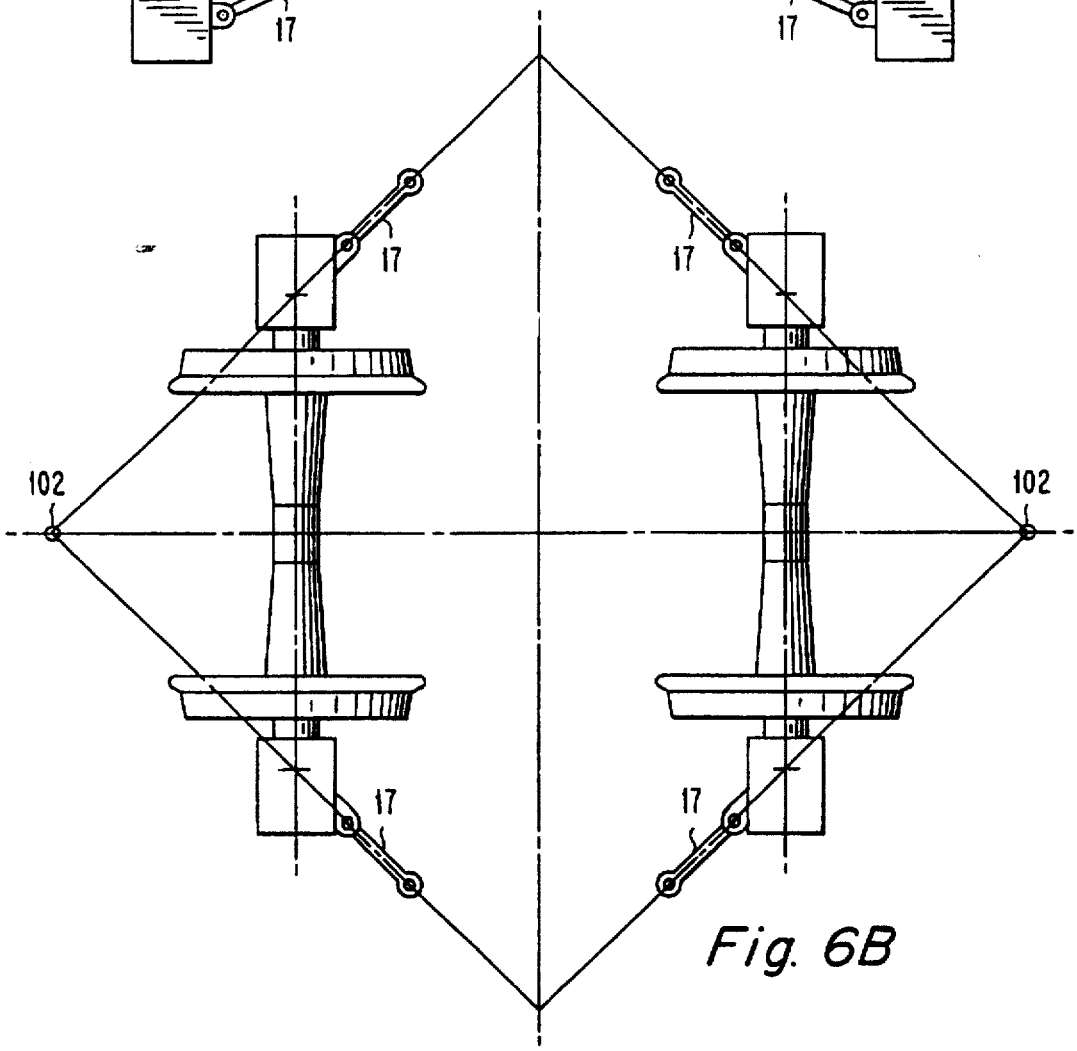
Fig. 6B

Fig. 6C
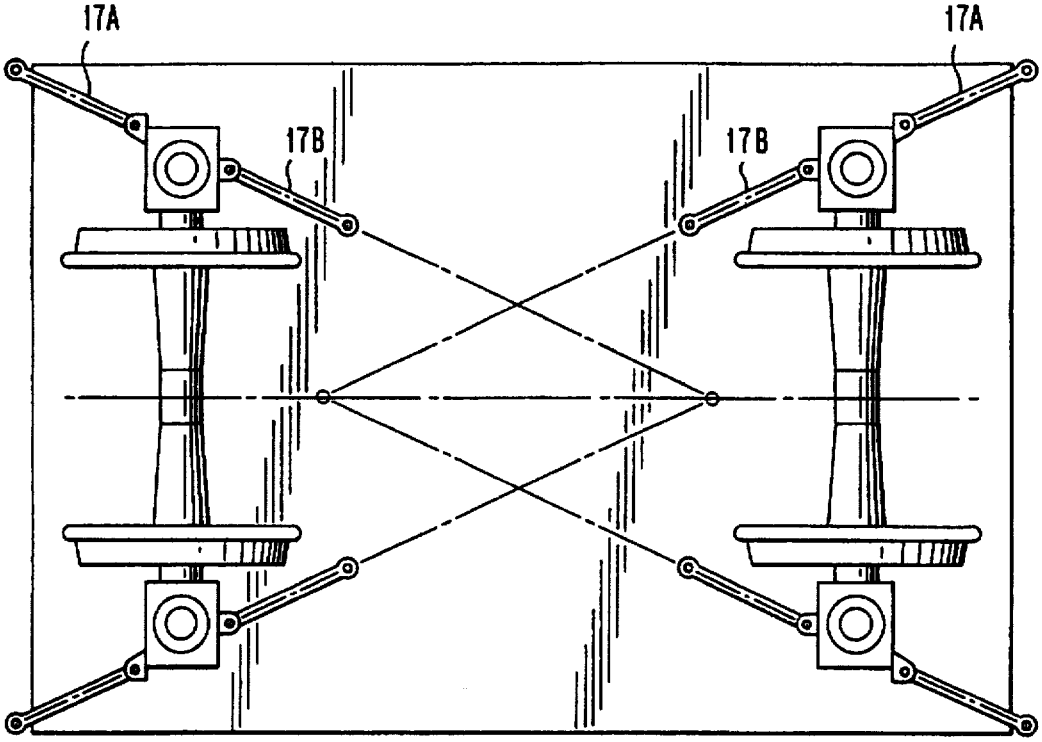
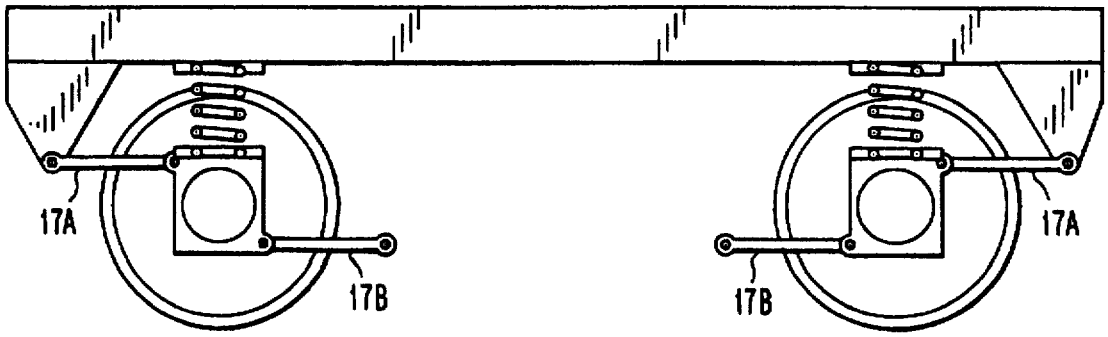
Fig. 6D

Fig. 6G
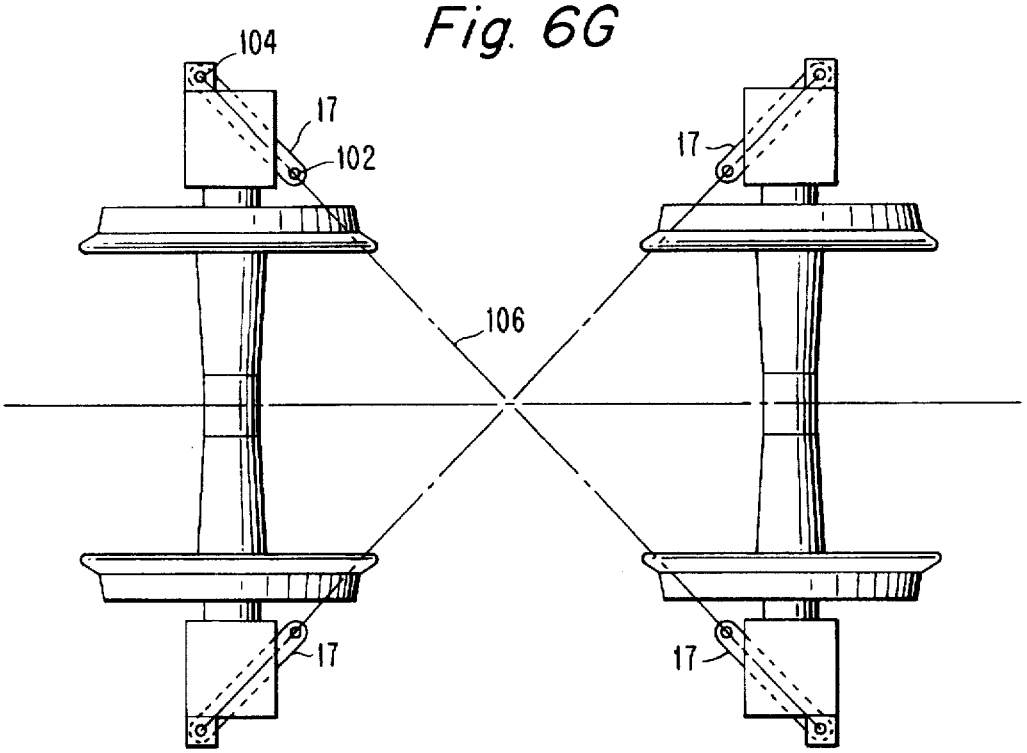
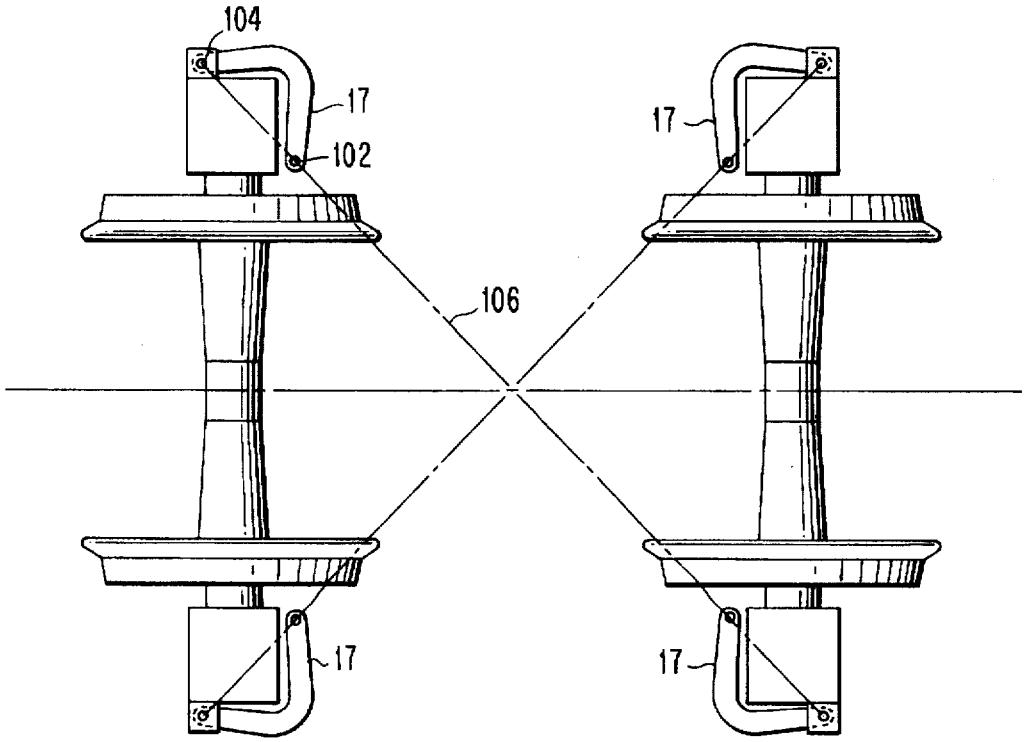
Fig. 6H

RAILWAY VEHICLE SUSPENSIONS

RELATED INVENTION

This is a continuation-in-part of U.S. Ser. No. 08/207,730 filed Mar. 9, 1994 now U.S. Pat. No. 5,588,367.

BACKGROUND OF THE INVENTION

This invention relates to railway vehicle suspensions.

It is known that the wheelsets of railway vehicles which have live axles and wheels with conical or profiled treads are prone to excite oscillations of the vehicle in the lateral plane and such oscillations, often referred to as hunting, become unstable beyond a certain critical speed. For safe operation it is essential that this critical hunting speed is higher than the maximum operating speed of the vehicle and as operating speeds of trains have been steadily increasing in recent years novel railway vehicle suspensions are required to cope with this hunting problem.

An analysis of the hunting phenomenon shows that for the simplest railway vehicle or railway bogie which has two wheelsets the critical hunting speed decreases with increasing mass of the wheelsets and increases with increasing stiffness of the suspension elements which constrain the relative motions in the lateral plane of the two wheelsets, namely the yawing motions of the two wheelsets in an equal and an opposite sense of rotation and the relative lateral motions of the two wheelsets.

Conventionally the wheelset suspension consists of axle box springs and wheelset guidance elements which are elastic in the lateral and longitudinal directions. In this case the constraint to yawing motions of the two wheelsets in an equal sense of rotation and the constraint to relative lateral motions of the wheelsets (often referred to as shear stiffness) is generated by the combined in series elastic effect of the lateral and longitudinal stiffness of the elements which suspend the wheelsets to the bogie frame. The constraint to yawing motions of the two wheelsets in an opposite sense of rotation (often referred to as bending stiffness) is generated by the longitudinal stiffness of the elements which suspend the wheelsets to the bogie frame. Thus increases in shear and bending stiffness which, as mentioned above, will increase the critical speed of hunting, can be obtained by increasing the lateral and longitudinal stiffness of the elements which suspend the two wheelsets to the bogie frame. However, experience has shown that there is a limit to this as an increase in the stiffness of the wheelset suspension elements also causes the lateral and yaw oscillations of the bogie frame and the wheelsets to be strongly coupled dynamically and this has a de-stabilizing effect on the vehicle.

In order to avoid this de-stabilizing coupling effect between the bogie frame and wheelset oscillations it has been suggested to interconnect the wheelsets directly by means of lightweight, non-load carrying members in order to obtain a shear and bending stiffness between the wheelsets which is independent of the longitudinal and lateral stiffness of the elements which suspend the wheelsets to the bogie frame. An example is described in the specification of Wickens U.S. Pat. No. 3,528,374.

Stiff interconnections, typically in the form of cross-anchors or triangular frames joined at their apices to obtain a high shear stiffness have been applied particularly in the case of so-called self-steering or radial axle bogies which have a specified relatively low bending stiffness to allow the wheelsets to attain a radial position in curves, as exemplified by Scheffel U.S. Pat. No. 4,067,261 and 4,067,262.

However, it has been found that for such wheelset interconnections to be effective the wheelsets have to be fitted with sturdy sub-frames that add to the mass of the wheelset and result in a de-stabilizing effect which at least partially offsets the gain in stability attributable to the elastic interconnection of the wheelsets.

Furthermore the application of known wheelset interconnections of cross-anchor or triangular frame type is limited to adjacent wheelsets. British Patent No. 1,508,194 to Wickens describes cross-anchor type interconnections between non-adjacent wheelsets, but teaches no practical method by which such interconnections can be achieved. Non-adjacent wheelsets are generally too far apart to allow for an effective wheelset interconnection of the known type to be fitted. However, an analysis of the hunting stability of multiaxle vehicles shows that the stability of the vehicle can be increased substantially if adjacent as well as non-adjacent wheelsets are interconnected with each other.

A further problem with known cross-anchor or triangular frame wheelset interconnections is that they cannot always be readily fitted due to space limitations. This applies particularly to motorized bogies and high speed bogies with elaborate brake gear.

As an alternative to the known cross-anchor or triangular frame interconnections it has been suggested to fit linkages between the wheelsets, which linkages are also attached to the bogie frame. See, for example, Scales U.S. Pat. No. 3,862,606, South African Patent 86/0633 to Lukens General Industries Inc., and South African Patent 82/6357 to Scheffel.

However, it has been found that such linkages do not improve the hunting stability of the bogie because the linkages do not only constrain the motions of the wheelsets in the lateral plane, but also the motions of the bogie frame. This causes the motions of the wheelsets and the motions of the bogie frame to be dynamically coupled, and such dynamic coupling negates the stabilizing effect of the linkages.

SUMMARY OF THE INVENTION

A first aspect of the invention provides a railway vehicle which includes a frame suspended on at least two wheelsets, each wheelset having a live axle which has ends mounted in respective axleboxes, and couplings which are attached to the frame and which couple an axlebox of one wheelset to an axlebox of another wheelset in such a manner as to constrain relative movements between the wheelsets in a lateral plane, each coupling including interconnected crank levers which operate to uncouple lateral movements of the frame from the movements of the wheelsets. As used in this specification, the term "railway vehicle" embraces not only railway vehicles in which the vehicle body is supported on bogies, but also vehicles in which the vehicle body is supported directly on wheelsets, vehicles in which a combination of bogies and wheelsets is used to support the vehicle body, and vehicles in the form of bogies themselves. The term "frame" as used herein embraces the vehicle body or superstructure in the case of a vehicle in which the body is supported directly on the wheelsets, and/or the bogie frame in other cases.

Each coupling may comprise a linkage which includes links pivoted to the respective axleboxes at upright axes, the axes of the links intersecting or passing close to the geometrical center of the wheelsets coupled by the coupling. Alternatively, each coupling may comprise a linkage which includes links pivoted to the respective axleboxes at upright axes, the axes of the links intersecting one another at positions in front of or behind the geometrical center of the wheelsets coupled by the coupling.

In some cases, the linkages may include pairs of links pivoted to the respective axleboxes, with one link in each pair being located at an elevation above that of the axles and the other link in each pair being located at an elevation below that of the axles.

Typically, each crank lever is connected pivotally to the frame and has first and second arms, the first arm being connected pivotally to a link of the linkage, and the second arm being connected to the second arm of a crank lever associated with a different axlebox.

The second arms of the crank levers may be connected to one another by means of a resilient connector which is stiffer in the transverse direction of the railway vehicle than in the longitudinal direction thereof.

In one embodiment, the resilient connector includes a rigid link which extends in the transverse direction of the railway vehicle and to which the respective second arms of the crank levers are connected pivotally. The rigid link may connect the second arms of crank levers located on the same side of the frame, or it may connect the second arms of crank levers located on opposite sides of the frame.

In another embodiment, the resilient connector comprises a resilient bush formed with voids therein that promote greater stiffness in the transverse direction than in the longitudinal direction.

In other versions of the invention, the second arms of respective crank levers are coupled to one another by a partly mechanical and partly hydraulic coupling. In yet other versions of the invention, the hydraulic components of such arrangements can be replaced by electrically or magnetically actuated coupling components.

In the case of hydraulic components, the second arm of one crank lever can be connected to a piston reciprocable in a first hydraulic cylinder the ends of which are connected hydraulically to the opposite ends of a second hydraulic cylinder, the second arm of the other crank lever then being connected to a piston reciprocable in the second cylinder.

Further according to the invention, there is provided a railway vehicle which includes a frame suspended on at least two wheelsets, each wheelset having a live axle mounted at its ends in respective axleboxes, and couplings which couple an axlebox of one wheelset to an axlebox of another wheelset on the same side of the frame, the couplings being arranged to constrain relative yawing motions between the coupled wheelsets in a degressive manner.

The couplings may comprise springs, such as bellows-type springs, having a degressive characteristic. However, in a preferred embodiment of this aspect of the invention, each of the said couplings comprises;

crank lever pivoted to one of the axleboxes, spring biasing the crank lever to rotate in a first direction, and flexible strap which is connected between the crank lever and the other axlebox in such a manner as to bias the crank lever rotationally in a second direction opposite to the first direction when tensioned, the crank lever, spring and strap being arranged in relation to one another in such a manner that the turning moment imposed on the crank lever by the spring reduces when tension arising in the strap as a result of relative yawing between the coupled wheelsets is sufficient to cause the crank lever to rotate in the second direction, thereby to reduce the tension in the strap and cause a consequential reduction in the constraint to relative yawing motion between the coupled wheelsets.

BRIEF DESCRIPTION OF THE DRAWINGS

The invention will now be described in more detail, by way of example only, with reference to the accompanying drawings. In the drawings:

FIGS. 6A to 6H diagrammatically illustrate further inclined link configurations;

DESCRIPTION OF EMBODIMENT

Figure 1:
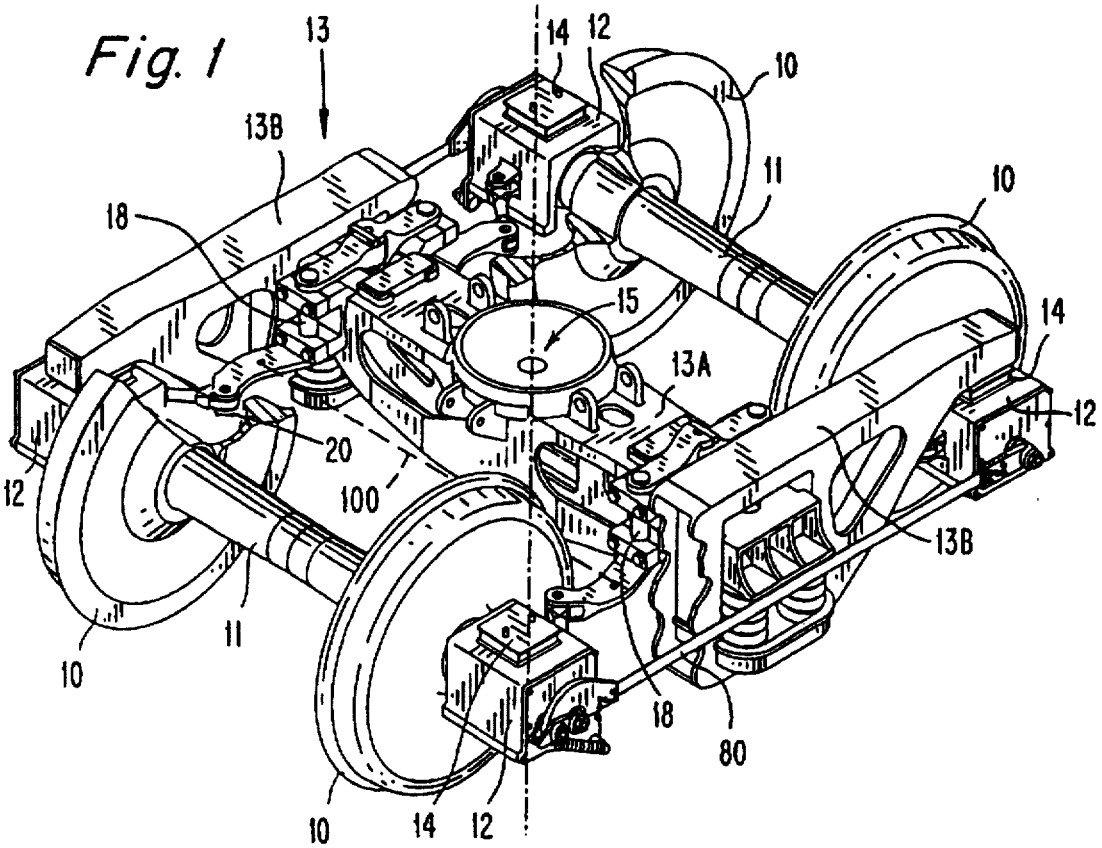
FIG. 1 shows a partially fragmented perspective view of a bogie incorporating suspension according to the invention.

FIG. 1 of the drawings shows a three-dimensional view of a bogie having two wheelsets. The wheels 10 of the wheelsets have conical or profiled treads and are secured on axles 11 journalled in axleboxes 12. The bogie has an H-shaped frame 13 which consists of three parts, namely a transverse bolster 13A and two side frames 13B. In other embodiments, the frame may be of one-part construction.

The frame 13 is suspended on axlebox springs 14 having vertical, lateral and longitudinal stiffness. At the center of the bolster 13A, the bogie frame has a pivot 15 on which a vehicle super-structure or body (not shown) is mounted in use of the bogie. Alternative arrangements for mounting the vehicle super-structure on the bogie frame 13 are also possible. Such mounting may, for instance, be effected by means of springs located on the transverse center line of the bogie, equally spaced from the longitudinal center axis referred to as a "sill support" arrangement.

Links 17 (FIG. 2) are pivotally connected to the axleboxes 12 by means of spherical joints 16. The links 17 lie substantially in the horizontal plane of the axles and are inclined in relation to the longitudinal axis of the bogie in such a manner that an imaginary extension of the axis of each link 17 points substantially towards the vertical geometrical center of the bogie, between the two wheelsets.

In the illustrated case, the links 17 point from the axlebox pivot pins 16 towards the geometrical center, but in other embodiments, the links 17 can point away from the axlebox pivot pins towards the ends of the side frames 13B of the bogie.

Mounted on the bolster 13A, or in other embodiments on the side frames 13B, by means of vertical shafts 18, are pivoted levers 19. The shafts 18 are rotatable relative to the side frames. Each lever 19 is in the form of a crank lever in that it has two arms 19A and 19B. The arm 19A lies in substantially the same plane as the associated link 17 and is connected to the free end of that link by means of a spherical joint 20.

The other arm 19B of the crank lever 19 extends longitudinally from the shaft 18 towards the transverse center line of the bogie as illustrated. Due to space constraints, the arm 19B is in a higher horizontal plane than the arm 19A and link 17, with the shaft 18 serving to connect the arms 19A and 19B rigidly to one another.

In the illustrated case, the arms 19A and 19B of each crank lever are generally aligned with one another, but it should be appreciated that this is not necessarily the case in all embodiments.

The arms 19B of the two crank levers 19 on the same side of the bogie are connected to one another at a flexible joint 21. The joint 21 may include a transverse link 22 as seen diagrammatically in FIG. 3, or a rubber bush 30 as seen diagrammatically in FIG. 4. In the latter case, one crank lever arm 19B is connected to the bush 30 while the other crank lever arm 19B is connected to a pin passing axially through the bush.

Figure 4:
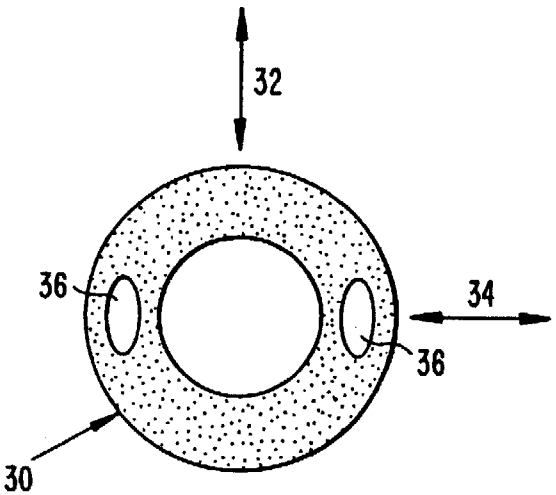
FIG. 4 diagrammatically illustrates a rubber bush used to connect two crank levers to one another.
Figure 3:
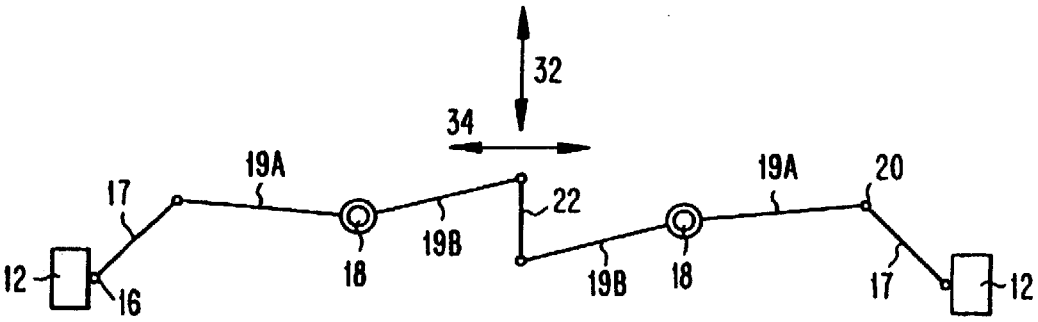
FIG. 3 diagrammatically illustrates one way in which two crank levers can be connected to one another.

In the FIG. 3 arrangement the link 22 gives a high degree of stiffness to the joint between the arms 19B in a lateral direction, i.e. in the direction 32. The link 22 can extend at right angles to the rails as shown or it can be inclined transversely at an angle other than 90'. The degree of stiffness of the joint in the longitudinal direction of the bogie, i.e. in the direction of the arrow 34, is relatively less. In similar fashion, the voids 36 provided in the rubber bush 30 of FIG. 4 give the joint between the arms 19B considerably greater stiffness in the lateral direction 32 than in the longitudinal direction 34.

It will be recognized that the connections between the axleboxes 12 are made by linkages which extend along the side frames 13B, and which accordingly do not in any way obstruct the central space that may be required to house motor drive or braking equipment.

In other embodiments, a link corresponding to the link 22 can extend along the center line of the bolster 13A to interconnect an arm 19B on one side of the bogie with a diagonally opposed arm 19B on the other side of the bogie. In such cases, the axlebox interconnections clearly do not extend wholly alongside the side frames 13B.

However, the location of the links 22 on the bolster 13A will again result in little or no consumption of central space that may be required for other components of the railway vehicle.

The operation of the linkages described above is as follows, assuming that one of the wheelsets moves laterally and/or yaws relative to the other wheelset. The lateral or yawing movement of the relevant wheelset causes the associated link 17 to rotate.

Figure 2:
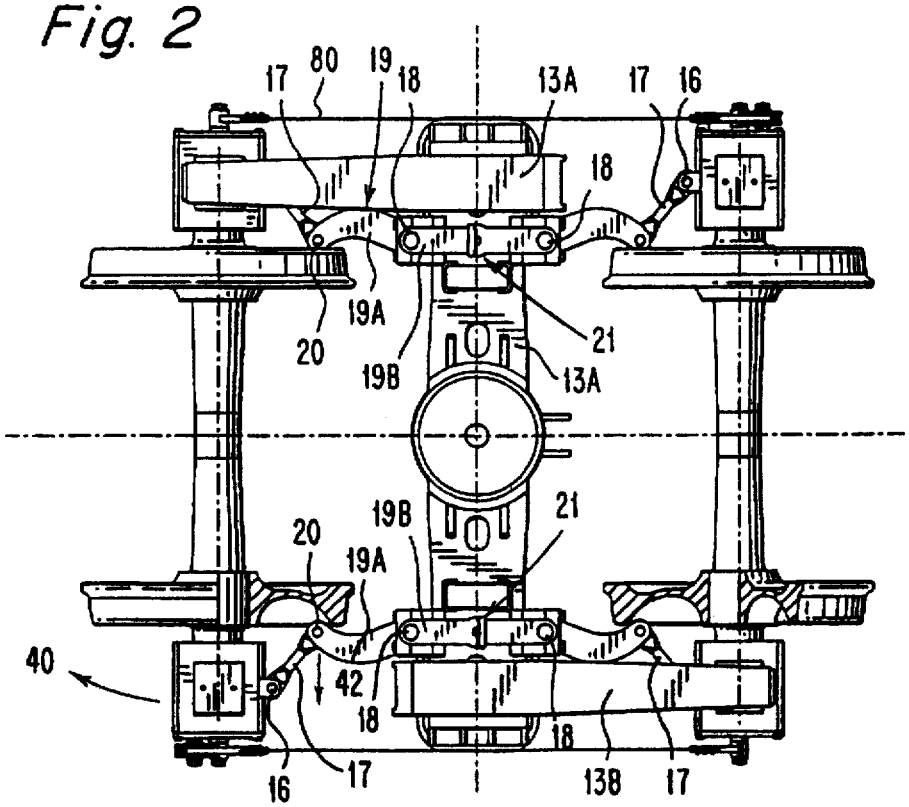
FIG. 2 shows a plan view of the bogie seen in FIG. 1.

For instance, assuming that the left hand wheelset in FIG. 2 yaws in a clockwise sense as indicated by the arrow 40, the motion of the link 17 causes the joint 20 to move in the direction indicated by the arrow 42. This in turn causes the crank lever 19 to pivot anti-clockwise about the axis of the shaft 18. The end of the arm 19B at the joint 21 will tend to move towards the longitudinal center axis of the bogie. This will in turn constrain the arm 19B to which it is connected to undertake a similar movement.

In the result, relative yawing between the wheelsets is constrained and the hunting stability of the bogie is improved. In other words, the effective shear stiffness of the bogie suspension has been increased, with a resulting increase in hunting stability and in the critical speed at which the vehicle can travel.

The effective shear stiffness of the suspension has not however been increased by dynamically coupling the bogie frame 13 or the vehicle superstructure with the wheelsets.

This is because the reaction forces on the bogie frame at the points of connection of the linkages to the bolster 13A, i.e. at the axes of the shafts 18, are directed towards the geometrical center, midway between the wheelsets. These reaction forces are in equilibrium at the geometrical center.

The couplings described above serve to transmit longitudinal forces from the wheelsets to the bogie frame in a manner to avoid the necessity for expensive and elaborate linkages such as those described in Scheffel et al. U.S. Pat. No. 4,735,149, even if soft longitudinal axlebox springs are used to obtain good steering characteristics.

The bogie frame is effectively dynamically uncoupled from the wheelsets and is not constrained to move by the coupling between the wheelsets. In the final result, the lateral and/or yawing movements of the wheelsets are not transmitted to the bogie frame or the superstructure supported by the bogie frame. The bogie frame and vehicle superstructure are free to yaw and move laterally relative to the wheelsets.

In the embodiment described above, couplings are provided between adjacent wheelsets. It will however be appreciated that the principles of the invention as exemplified above can equally well be applied to wheelsets which are not adjacent one another. The wheelsets may in fact be on different bogies.

Figure 5:
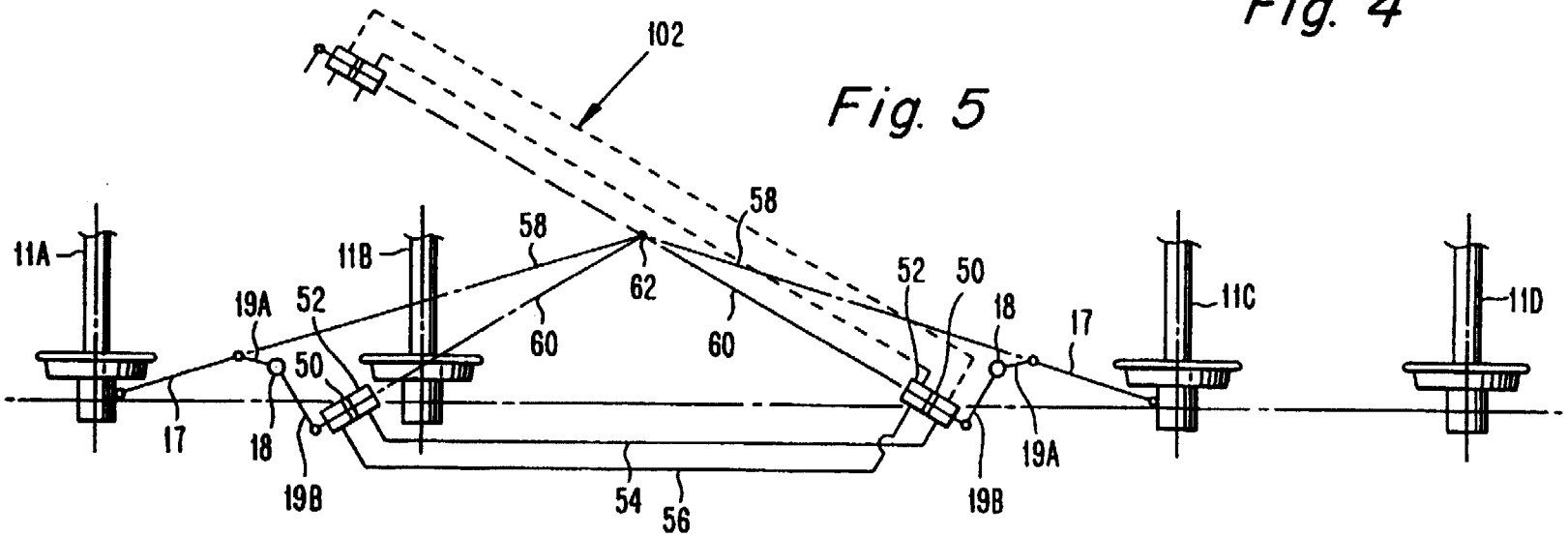
FIG. 5 diagrammatically illustrates how non-adjacent wheelsets can be coupled.

FIG. 5 of the drawings illustrates one way in which the required couplings between non-adjacent wheelsets can be achieved in practice.

In this Figure, components corresponding to those of the previous Figures are designated with the same reference numerals. FIG. 5 shows four axles 11A, 11B, 11C and 11D and a coupling in accordance with the invention between the axles 11A and 11C. The arms 19B of the crank levers 19 are pinned to the piston rods of pistons 50 which move in hydraulic cylinders 52. The ends of the cylinders 52 are connected in opposite relationship by hydraulic lines 54 and 56. The cylinders Ire mounted solidly on the vehicle superstructure (not illustrated).

Yawing or lateral movement of, say, the wheelset having the axle 11A relative to the wheelset with which it is coupled hydraulically gives rise to reaction forces indicated by the lines 58 and 60. The reaction forces are directed to the geometrical center 62, midway between the wheelsets 11A and 11C.

Given that similar reaction forces arise on the opposite side of the vehicle, and that those similar forces are also directed to the geometrical center 62, it will be appreciated that the reaction forces are in equilibrium as in the first embodiment.

It will also be recognized that any number of inter-wheelset couplings, over any distances, can be made with the mechanical/hydraulic technique exemplified in FIG. 5. Adjacent wheelsets can of course be mechanically coupled in the manner seen in FIGS. 1 and 2, with only non-adjacent wheelsets hydraulically coupled.

In the embodiments described above, the axes of the relevant links intersect at the relevant geometrical centers, leading to a balance of forces at those centers. Experimentation by the inventor indicates that this is not necessary in all cases and that advantageous shear stiffening effects can still be obtained using links which are inclined to the longitudinal axis of the vehicle but which are nevertheless not so arranged that their own axes intersect the geometrical center under consideration.

Some alternative arrangements are illustrated diagrammatically in FIGS. 6A to 6F. In these Figures, the majority of components other than the links 17 themselves are omitted.

In FIG. 6A, the link axes intersect at spaced apart points of intersection 100 located between the coupled wheelsets. In FIG. (1B, the links point outwardly, as discussed previously, and their axes meet at points of intersection 102 which are located outside the coupled wheelsets. In both cases, the coupled wheelsets may either be adjacent or non-adjacent wheelsets.

If it is difficult to fit the links in substantially the same horizontal plane as the axles 11, or if it is desirable that the axle boxes should not be able to rotate freely, as may be the case with motorized axles to ensure efficient transmission of traction forces from the axle boxes to the frame, two links, staggered apart from one another in a vertical sense, may be provided per axle box. This type of arrangement is seen in plan view in FIG. 6C and side view in FIG. 6D.

One of the links 17A is positioned above the plane of the axles while the other link 17B is positioned below the plane of the axles. Opposite ends of each link 17A are pivotally connected to the axle box and bogie frame respectively while opposite ends of each link 17B are pivotally connected to the axle box and the crank lever 19 (not illustrated in FIGS. 6C and 6D). In practice, the link 17A may be fitted substantially at right angles to the axle when viewed in plan.

The double links 17A, 17B at each axle box can be arranged to point in opposite directions, as shown in FIGS. 6C and 6D, or in the same direction. Also the angles of inclination of the two links do not have to be the same. In the case of a three axle bogie this feature can be utilized to couple the upper (or lower) links to the crank levers 19 interconnecting the non-adjacent wheelsets and the lower (or upper) links to the crank levers 19 interconnecting the adjacent wheelsets of the three axle bogie.

Figure 6E:
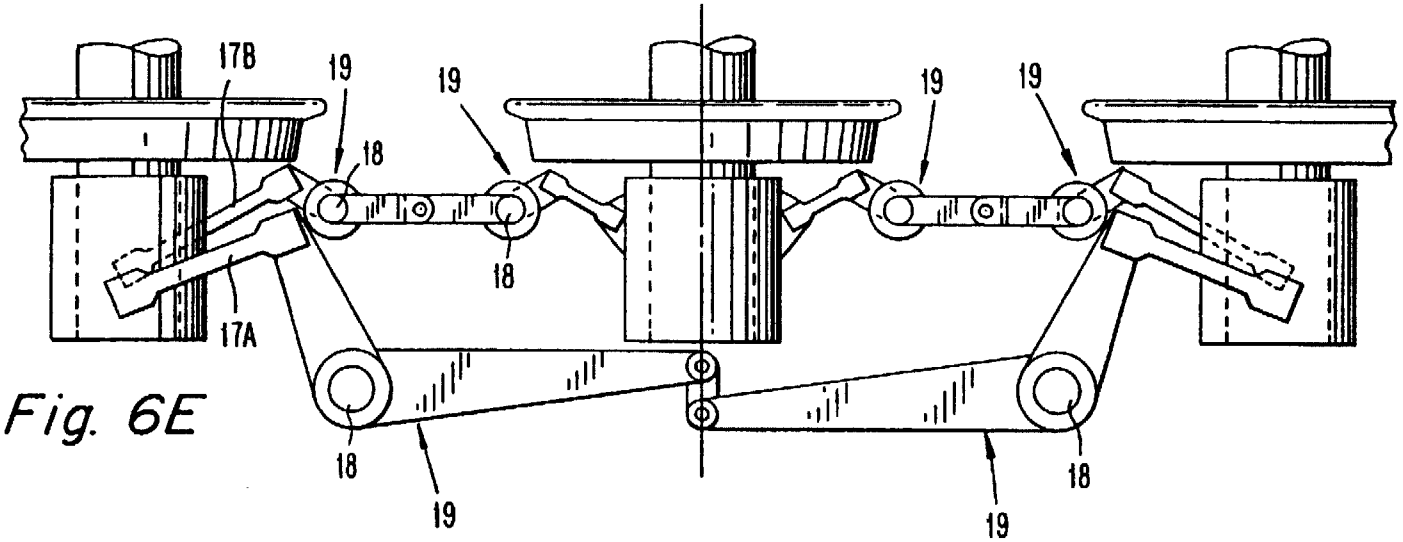
Figure 6F:
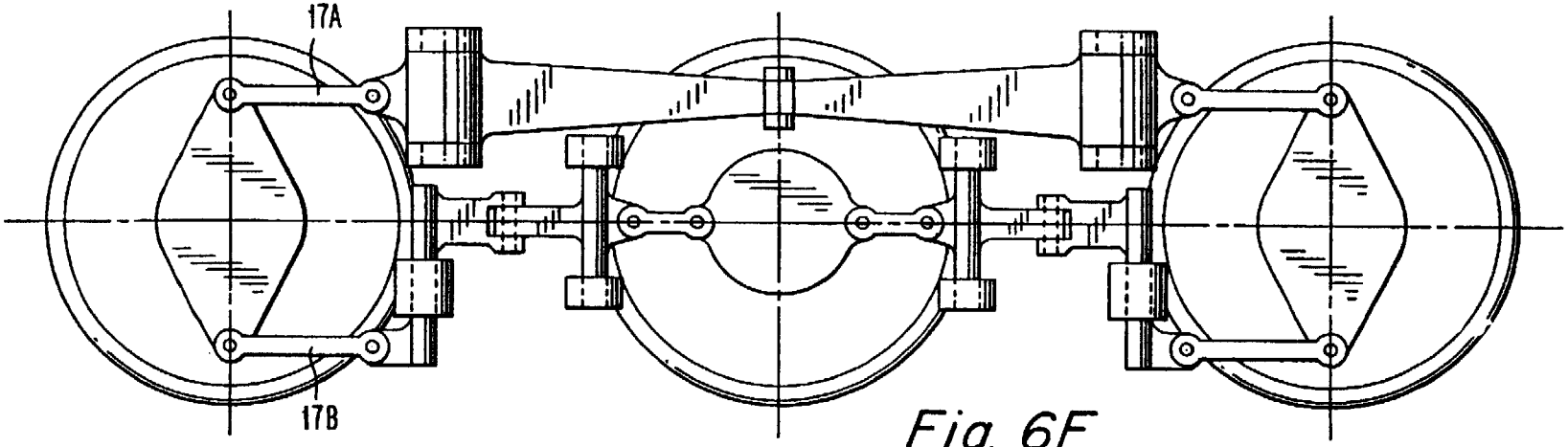

Such an arrangement is illustrated in FIGS. 6E and 6F, which illustrate a three axle configuration, FIG. 6F showing a side view of the FIG. 6E configuration. As before, the vertical shafts 18 of the various crank levers 19 associated with the upper and lower links 17A, 17D are mounted rotatably in brackets 23 which are part of the bogie frame (not illustrated in FIGS. 6E and 6F).

Referring again to FIG. 1, a strap or rod may be connected between the couplings on opposite sides of the vehicle. It may for instance be connected between the crank arms 19A on opposite sides of the vehicle as shown by the broken line 100 in FIG. 1.

The provision of the connecting rod or strap ensures effective transmission of braking and traction forces from the vehicle superstructure to the wheelsets even if the forces acting on the two wheelsets of a coupled pair are not of the same magnitude.

In an arrangement such as that of FIG. 5, it should also be noted that diagonally opposite hydraulic cylinders could be interconnected either alone or in addition to the connections between hydraulic cylinders located at the same sides of the coupled wheelsets. A typical diagonal interconnection is indicated with the reference numeral 102 in FIG. 5.

Figure 7B:
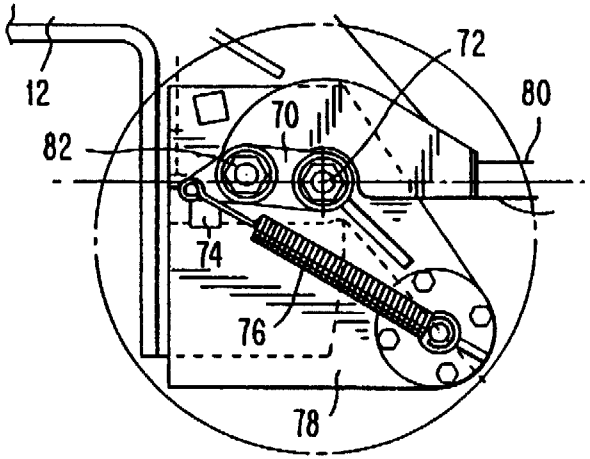
FIG. 7B is an enlarged view of a fragment of FIG. 7A.
Figure 7A:
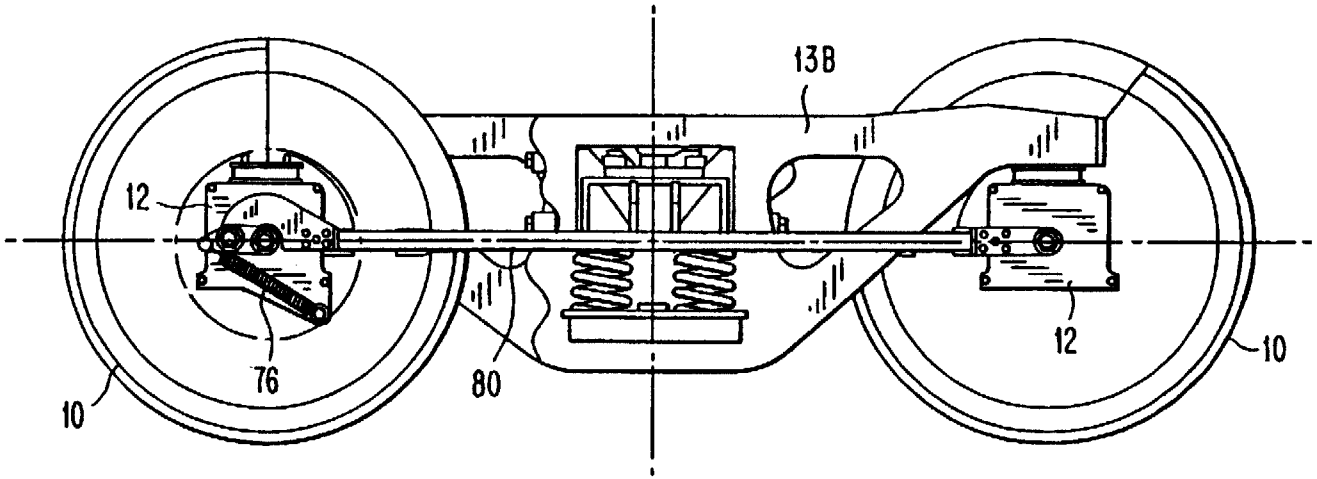
FIG. 7A shows a side view of the bogie depicted in FIG. 1.
Figure 8:
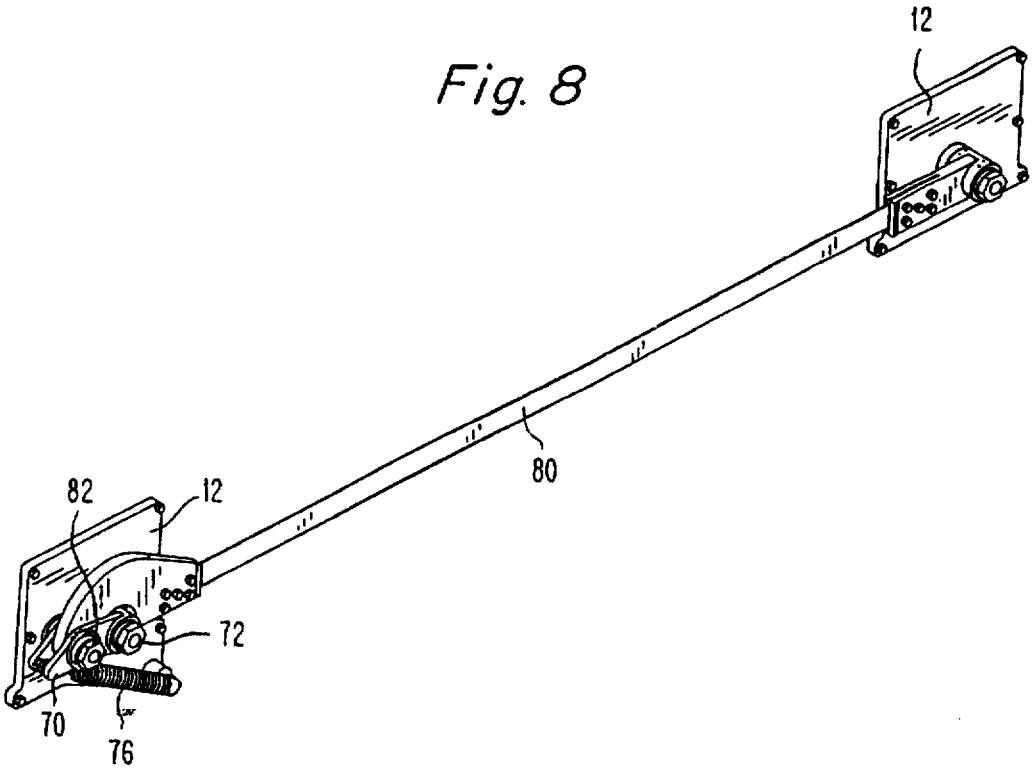
FIG. 8 shows a perspective view of an embodiment dgressive bending stiffener of the invention.

FIGS. 1 and 2, read with FIGS. 7 and 8, also illustrate a further embodiment which is provided to adjust bending stiffness and accordingly to enhance the curving ability of the vehicle.

In practice, if the springing between the axleboxes and the bogie frame provides a low level of yaw constraint, small yaw motions of the wheelsets caused by localized track irregularities, even on straight track, are not adequately resisted and there is a reduction in the level of hunting stability. On the other hand, if the springing between the axleboxes and the bogie frame provides a very high degree of yaw constraint, the wheelsets will rapidly be returned to a condition in which they are parallel to and aligned with one another after small yaw motions have taken place. However, too high a level of yaw constraint will inhibit the wheelsets from steering themselves properly through curves, even if the wheels have the appropriate tread profile.

It is believed that this problem can be overcome by providing for a yaw constraint with a degressive characteristic. This may, for instance, be achieved using springs which provide high yaw constraint over a certain range of initial deflection and which then digress, i.e., their spring force decreases with further increases in spring deflection. In the ideal situation, high yaw constraint is provided at low spring deflections to enhance hunting stability on straight sections of the rail track.

When the bogie fitted with wheels having a high effective tread conicity enters a curve, high longitudinal creep forces are generated. This will cause the deflection of a degressive spring to increase until such time as the degressive characteristic of the spring comes into play.

The yaw constraint provided by the spring then reduces to a low enough level for the wheelsets to assume radial positions in curves and thereby ensure off-flange curving.

Research by the inventor has shown that for optimal hunting stability and curving ability the springs should have a degressive characteristic which rises steeply for an initial small wheelset yaw deflection and then drops off sharply towards the yaw constraint of self-steering bogies as the yaw deflection approaches the radial values for a 300 m curve. An optimal characteristic is depicted graphically in FIG. 9.

In practice it is believed that the desired situation could be achieved, in accordance with the invention, by longitudinally orientated degressive springs, such as known bellows type springs, fitted between each axlebox and the bogie frame.

Alternatively such springs can be fitted so as to act, via a stiffener, between the two axleboxes of adjacent wheelsets on either side of the bogie.

An alternative and preferred embodiment is illustrated in FIGS. 1, 2 7 and 8. In this embodiment, there is a crank lever 70 pivoted to the axlebox 12 by a pivot pin 72. The crank lever 70 is biased firmly against a stop 74 by a spring 76 which is connected at its upper end to the crank lever and at its lower end to a bracket 78 extending from the axlebox. The spring is installed in a pre-stressed state so as to generate the required biasing force to urge the crank lever against the stop.

One end of a flexible rope or strap 80 is connected to the crank lever 70 at a connection 82. The strap 80 is only capable of transmitting tensile forces. The other end of the strap 80 is connected to an adjacent axlebox 12 on the same side. The strap has a carefully chosen elasticity and is installed in such a manner that it is without slack but is virtually unstressed when the wheelsets are parallel to and aligned with one another.

If one of the wheelsets commences a yawing motion on a straight section of track as a result, for instance, of a localized track irregularity, the distance between the axleboxes of adjacent wheelsets on one side of the bogie will increase and correspondingly decrease on the other side of the bogie. On the side where the axleboxes have moved apart, i.e. where the wheelbase has increased, the strap 80 is stretched but the crank lever 70 remains held firmly against the stop 74 by the spring 76.

Figure 9:
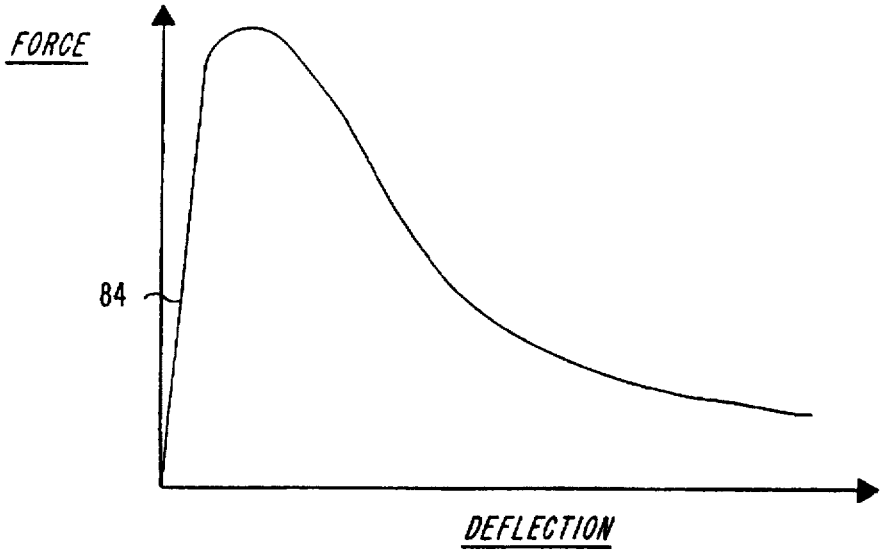
FIG. 9 graphically illustrates a desirable degressive spring characteristic.

The stretching of the strap generates a force on the wheelset axleboxes which are connected by the crank lever 70 and strap. This force opposes the yawing motion and tends to restore the wheelsets to their parallel and aligned positions. Thus it will be noted that the strap imposes a high yaw constraint under conditions of this kind. Referring to FIG. 9, this action takes place in the part of the deflection curve marked with the numeral 84.

If, on the other hand, the bogie enters a curved section of track, the longitudinal creep forces generated by the wheel tread conicity will cause the leading wheelset to yaw.

The strap is again caused to stretch on the side of the bogie where the wheelbase increases. However, in this situation, the turning moment (clockwise in FIG. 7) about the axis of the pin 72 that is created by the tension in the strap overcomes the turning moment (anti-clockwise in FIG. 7) created by the spring force. The crank lever 70 rotates clockwise away from the stop 74.

As a result of the rotation of the crank lever the moment arm of the spring force about the axis of the pivot pin 72 reduces and the moment arm of the strap increases. Thus the tension in the strap will reduce correspondingly and the initial high yaw constraint, which would normally prevent the wheelsets from attaining the desired radial positions in the curve will digress to a value consistent with desired radial positions for off-flange curving.

The spring-loaded crank lever 70 could also be mounted on the bogie frame 13 rather than the axlebox 12. In this case one crank lever arrangement would be required for each axlebox with an elastic strap connecting each axle box with to its own crank lever arrangement.

Referring again to the first embodiment described above, this arrangement can be fitted to self-steering or radial axle bogies in place of conventional cross-anchor arrangements, with a view to improving hunting stability. Also, it is believed that the described apparatus could be retro-fitted to existing bogies of conventional, non self-steering type.

This could involve replacing the longitudinal axlebox springs with softer springs that would give a self-steering capability to the bogie. The retro-fitting of the described apparatus would then improve the bunting stability of the bogie. Of course, even if the longitudinal axlebox springs are not replaced to give a self-steering capability, the addition of the apparatus of the invention will improve the hunting stability.

The degressive bending stiffener arrangement described with reference to FIGS. 1, 2, 7 and 8 can be retro-fitted to existing bogies of self-steering or radial axle type to increase hunting stability.

A combination of the frame-mounted shear stiffener and degressive stiffener arrangements could, of course, also be provided.

Referring again to the shear stiffening components described previously, it will be noted that the these components are depicted in the relevant Figures as being symmetrical about the transverse center line.

It should however be appreciated that this will not always be the case, particularly in situations where space constraints make it essential to lengthen certain links but not others.

Reference was made above to the use of the configuration shown in FIGS. 6C and 6D in situations where difficulty is encountered, in a particular railway vehicle, in fitting the links into position. FIGS. 6G and 6H illustrate other possible configurations where space constraints prevent installation of links 17 in the manner seen in, for instance, FIGS. 1 and 2.

In each of FIGS. 6G and 6H, the link 17 has a curved shape. Referring to FIG. 6G, each link 17 lies in a vertical plane. The ends of the link are connected to the associated crank lever and to the axle box at respective first and second pivotal axes 102 and 104. Between these axes, the link extends in a curve beneath the associated axlebox. The links in this case lie on link-axes 106, i.e. the axes passing through the pivotal axes 102 and 104, which intersect on the longitudinal axis, substantially at the geometrical center.

In FIG. 6H, the links 17 lie in the horizontal plane of the axles and extend in a curve about the end and side of the associated axleboxes. Once again, the link axes 106 intersect on the longitudinal axis at the geometrical center of the frame.

Although the invention has been described in connection with detailed embodiments thereof, it will be appreciated by those skilled in the art that additions, modifications, substitutions and deletions not specifically described may be made without departing from the spirit and scope of the invention as defined in the appended claims.

What is claimed is:

1. A railway vehicle which includes a frame suspended on at least two wheelsets coupled to one another and spaced from one another along a longitudinal axis of said frame, each of said coupled wheelsets having a live axle which has ends mounted in respective axleboxes, and couplings which are attached to the frame and which couple the axleboxes of one of the coupled wheelsets to the axleboxes of the other of the coupled wheelsets in such a manner as to constrain relative lateral movements between the coupled wheelsets in a lateral plane, wherein each coupling includes a linkage comprising interconnected crank levers which operate to uncouple lateral movements of the frame from the movements of the coupled wheelsets and links which are pivoted to the crank levers at first upright axes and to the axleboxes at second upright axes, the first and second upright axes lying on link axes which are inclined to the said longitudinal axis and the arrangement of the links being such that each link axis intersects another link axis substantially on the said longitudinal axis.

2. A railway vehicle according to claim 1 wherein the link axes intersect one another at positions substantially on the said longitudinal axis and substantially at the geometrical center of the frame.

3. A railway vehicle according to claim 1 wherein pairs of link axes intersect one another at positions substantially on the said longitudinal axis and spaced from the geometrical center of the frame.

4. A railway vehicle according to claim 1 wherein the links have a curved shape between the said first and second uptight axes.

5. A railway vehicle according to claim 4 wherein the links lie substantially in the horizontal plane of the axles.

6. A railway vehicle according to claim 4 wherein the links pass beneath the axleboxes to which they are pivoted.

7. A railway vehicle according to claim 1 wherein each crank lever is connected pivotally to the frame and has first and second arms, the first arm being connected pivotally to an associated one of the links at one of the first upright axes.

8. A railway vehicle according to claim 7 wherein the second arm of each crank lever is connected to the second arm of a crank lever associated with a different axlebox.

9. A railway vehicle according to claim 8 wherein the second arms of the crank levers are connected to one another by means of a resilient connector which is stiffer in the transverse direction of the railway vehicle than in the longitudinal direction thereof.

10. A railway vehicle according to claim 9 wherein the resilient connector comprises a rigid link which extends in the transverse direction of the railway vehicle and to which the respective second arms of the crank levers are connected pivotally.

11. A railway vehicle according to claim 10 wherein the rigid link connects the second arms of crank levers located on the same side of the frame.

12. A railway vehicle according to claim 10 wherein the rigid link connects the second arms of crank levers located on opposite sides of the frame.

13. A railway vehicle according to claim 9 wherein the connector comprises a resilient bush formed with voids therein that promote greater stiffness in the transverse direction than in the longitudinal direction.

14. A railway vehicle according to claim 1 and comprising further couplings which couple an axlebox of one wheelset to an axlebox of another wheelset on the same side of the frame, the said further couplings being arranged to constrain relative yawing motions between the coupled wheelsets in a degressive manner.

15. A railway vehicle according to claim 14 wherein each said further coupling comprises:

a crank lever pivoted to one of the axleboxes, a spring biasing the crank lever to rotate in a first direction, and a flexible strap which is connected between the crank lever and the other axlebox in such a manner as to bias the crank lever rotationally in a second direction opposite to the first direction when tensioned, the crank lever, spring and strap being arranged in relation to one another in such a manner that the turning moment imposed on the crank lever by the spring reduces when tension arising in the strap as a result of relative yawing between the coupled wheelsets is sufficient to cause the crank lever to rotate in the second direction, thereby to reduce the tension in the strap and cause a consequential reduction in the constraint to relative yawing motion between the coupled wheelsets.

* * * * *